United States Patent [19]

Adinolfi

[11] 4,040,432

[45] Aug. 9, 1977

[54] HAIR STYLING TOOL

[75] Inventor: Rocco J. Adinolfi, Burlington, Mass.

[73] Assignee: The Gillette Company, Boston, Mass.

[21] Appl. No.: 672,745

[22] Filed: Apr. 1, 1976

[51] Int. Cl.[2] ..... A45D 1/00

[52] U.S. Cl. ..... 132/9

[58] Field of Search ..... 132/9, 85, 11 R

[56] References Cited

U.S. PATENT DOCUMENTS

| | | | |
|---|---|---|---|
| 3,890,985 | 6/1975 | Hicks | 132/9 |
| 3,903,905 | 9/1975 | Tucker | 132/9 |
| 3,931,826 | 1/1976 | Moon | 132/9 |

*Primary Examiner*—G.E. McNeill

*Attorney, Agent, or Firm*—Richard A. Wise; Oistein J. Bratlie; Raymond J. De Vellis

[57] ABSTRACT

A hair styling tool having a hand-grip portion and a mounting portion for receiving drying and/or styling attachments and including an integrally molded latching mechanism for providing one hand release of the attachment.

4 Claims, 4 Drawing Figures

HAIR STYLING TOOL

BACKGROUND OF THE INVENTION

The invention relates to styling apparatus typically used in conjunction with a portable hair dryer.

More particularly, the invention relates to a styling tool capable of receiving a plurality of attachments to aid in styling the operator's hair in a safe, efficient manner.

Electrically-heated forced-air hair dryers are used with tools such as styling handles capable of receiving a plurality of drying/styling implements or attachments for manipulating the hair while the hair dryer is being used. To most effectively use forced hot air hair dryers, a variety of hair drying/styling implements capable of being interchangably mounted on the housing of the dryer in a fixed position with respect to the stream of heated air and on an associated hair styling tool were provided. For example, a prior art styling handle such as disclosed in U.S. Pat. No. 3,903,905 owned by the assignee of this invention, illustrates a styling handle and hair dryer both of which are capable of receiving various drying/styling attachments. The attachments are capable of being connected to both the hair dryer and the handle by use of a mating tongue and groove construction. The use of the tongue and groove construction coupled with the required detents and recesses for locking the attachment in an operative position on the dryer as well as on the styling handle may result in the attachments not being readily releasable using only the operator's hand which is grasping the styling handle.

Further, such prior art constructions may cause the accidental disengagement of the attachment from the styling handle when a force along the axis of the styling tool (such as from tugging on the styling handle while the attachment is caught in the operator's hair) is realized.

Finally, hair styling handles which permitted two-handed styling in the past have typically resulted in a construction in which the end portion of the styling handle and the end portion of the associated attachment when mated, such as by sliding on and off, resulted in a parallel slot being formed between the face of the styling handle and the top portion of the attachment. The resulting gap or parallel slot at the extremity of prior art styling handles between the attachment and handle could result in the operator's hair becoming immeshed therein resulting in a less effective styling tool. The styling tool disclosed herein in a preferred embodiment includes at the outmost end of the styling handle a skirt portion which inlcudes pinholes for mating with pins on the associated contoured attachment. This construction of this invention therefore does not result in any such parallel slot necessarily associated with styling handles with slide-on attachments thereby realizing a more effective product.

SUMMARY OF THE INVENTION

It is the object of this invention to provide a styling handle which is capable of providing an efficient mounting and release of associated attachments in a safe and reliable manner.

It is also an object of this invention to provide a styling handle which will allow the associated attachments to be released using only the operator's hand which would normally grasp the styling handle, the styling handle being so constructed to avoid accidental ejection of the associated attachment.

It is a further object of this invention to provide an aerodynamically sound styling handle to be used in conjunction with a hair dryer in a one piece integrally molded design for ease of manufacture and assembly.

A final object of this invention is to eliminate any separate spring release assembly which necessitated a more difficult assembly and manufacture.

Briefly stated, and according to an aspect of this invention, the foregoing objects are achieved by providing an integrally molded hair styling tool having a gripping portion and a mounting portion for associated attachments. The construction of the styling handle allows the flow of air through the back of the working portion of the styling handle and provides for integrally molded gripping grooves on the gripping portion in a position where a slip of the operator's hand will not push off the associated attachment. The associated attachment is prevented from being pushed off the styling handle in a direction along the axis of the styling handle by an integrally modled lip portion at one end of the styling handle. A plurality of pin holes for mating with corresponding pins on a first end of the attachment also substantially prevents any rocking action occuring in some prior art designs of the associated attachment.

Further, an integrally molded release mechanism having a detent which mates with a corresponding detent at the second end of the attachment provides for an automatic deformation of the latching mechanism thereby realizing a positive automatic mounting of the attachment when the attachment is aligned in the appropriate pinholes and snapped into place.

The attachment is substantially incapable of being pulled or slid off the styling handle due to the positioning of the pins in the pinholes as well as the resiliency of the associated latching mechanism. The latching mechanism is provided with a release portion in the hollow body of the bottom portion of the handle to prevent an accidental depression of an integrally molded release tab. When the tab is pressed by simply slipping the operator's thumb from the appropriate gripping groove to the tab and pressing down the tab, thereby causing the detent of the latching mechanism to be moved in a clockwise direction, the attachment falls free of the styling handle due to the force of gravity. Therefore, a latching/release mechanism readily accessible to the operator and positioned to prevent unintentional unlatching of the attachment while being equally advantageous for either a right or left handed operator is achieved. A stiff rib is integrally molded halfway up the working portion of the handle which includes a plurality of slots for air flow purposes as well as for providing a structural integrity of the product.

The generally curvilinear shape of the styling handle provides a comfortable contour in the palm of the operator's hands. The gripping grooves are contoured to the thumb and forefinger of the operator's hand. Further, the formed structure aids in keeping the associated attachments in the proper position while in use by the operator.

The one-piece integrally molded handle as well as any attachment may be formed from a polycarbonate such as Lexan but other plastics which have a natural spring or resiliency such as nylon may be readily used.

BRIEF DESCRIPTION OF THE DRAWINGS

The invention both as to its organization and principles of operation together with further objects and advantages may better be understood by referring to the following detailed description of an embodiment of the invention taken in conjunction with the accompanying drawings, in which.

DESCRIPTION OF THE PREFERRED EMBODIMENT

Figure 1:
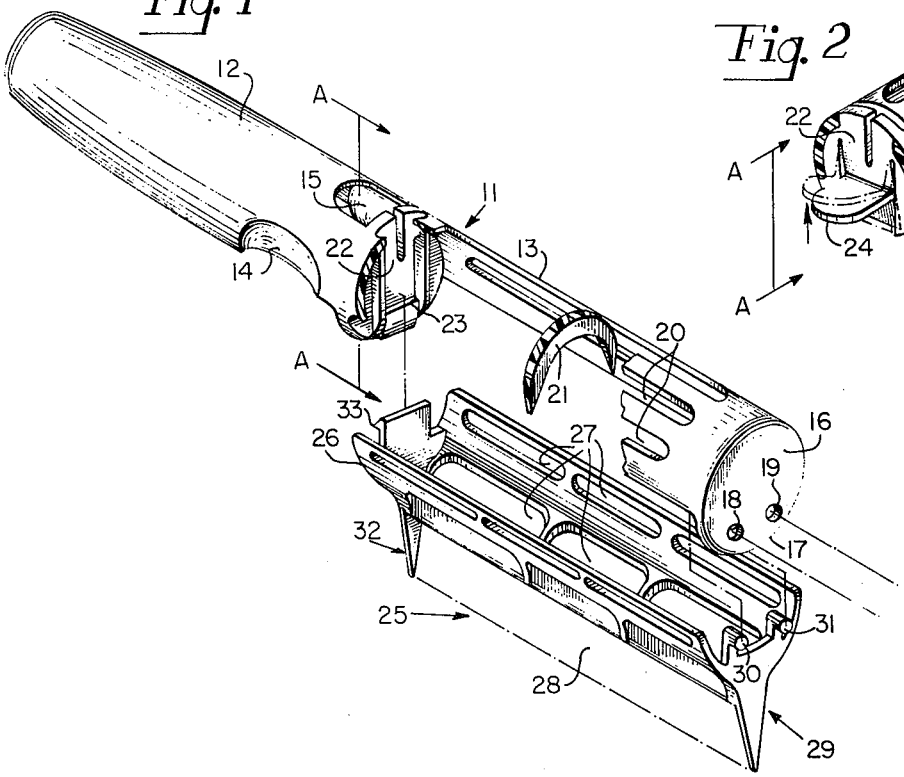
FIG. 1 is an isometric view, partially broken away, illustrating an exemplary embodiment of the styling tool and its relationship to a styling/drying attachment, in accordance with this invention.

Referring now to FIGS. 1 through 4, in which like portions will be designated with like numerals, there is shown a one-piece integrally molded styling tool or handle 11, generally cylindrical in shape. The handle 11 is preferably made from a polycarbonate such as Lexan but other plastics having a natural resiliency, e.g. nylon, are sufficient. The handle 11 is comprised of a lower or holding portion 12 and an upper or working portion 13. The holding portion 12 is preferably hollow and contoured to fit comfortably in the palm of an operator's hand. The holding portion 12 may include an integrally molded lower end member (now shown) at the extremity thereof as well as including gripping indentations or grooves 14 and 15 disposed on either sides of holding portion 12 and positioned toward the working portion 13 of the handle 11. The gripping grooves 14 and 15 are positioned to allow the operator or user of the handle 11 to firmly grasp the handle 11 and apply the desired torguing or twisting action to the handle 11 which is necessary for proper styling/drying. Further, the symmetrical configuration of the handle 11 with the gripping grooves 14 and 15 permit ease of operation for both left and right handed operators.

The upper or working portion 13 of the handle 11 is likewise contoured and includes an integrally molded upper end member 16 having an integral extended lip or skirt portion 17 which inlcudes openings or pinhole 18 and pinhole 19. Disposed parallel to the axis of the handle 11 in the working portion 13 are a plurality of longitudinal slots designated generally as slots 20. Slots 20 provide a passageway to allow a generated hot air stream from an associated hair dryer to pass therethrough toward the associated attachment. The working portion of the associated attachment is typically engaged in the hair of the operator with the air stream also directed therethrough. The longitudinal slots 20 in a preferred embodiment are five in number and are equally disposed about the surface of the working portion 13. The slots 20 provide versatility in the use of the handle 11 with various attachments in the drying/styling of the operator's hair.

An integrally molded rib 21 is provided approximately at the center of the working portion 13 and runs perpendicular to the slots 20. Rib 21 is of a thickness not to interfere with the aerodynamic air flow from the associated hair dryer while being strong enough to provide a more rigid handle to prevent a normal torguing force applied to the handle to misalign or expell the associated accessary or attachment.

The lip or skirt portion 17 of the upper end 16 serves a plurality of functions in association with the attachment. Because the skirt portion 17 is disposed over mating pins of the attachment in a manner to be described subsequently, there is no likelihood that the attachment would be accidently pushed or pulled off in a direction along the axis of the handle 11. This accidental expelling or misalignment of the attachment may occur in prior art handles that have an associated attachment which slides on the working end of a handle and the user of the handle pulls down on the handle while the working portion of the attachment was engaged in his or her hair. Further, the skirt portion 17 of the top end 16, when mating or interlocking with the attachment substantially eliminates the prior art problem of having an opening capable of catching the operator's hair, formed at the surfaces of the attachment and the top end of the styling handle thereby providing a safer, more efficient styling handle.

Integrally molded at approximately the center of the handle 11 is a latching release mechanism described generally as latching mechanism 22. The latching mechanism 22 includes an interlocking projection or detent 23 on its first side proximate to the working portion 13 which ultimately mates with the corresponding interlocking projection or detent on the associate attachment to be described subsequently. The latching mechanism 22 is constructed in such a way that it has a resiliency or natural spring tendency to remain in a first position as indicated generally in FIG. 2 by the solid lines, or to be deformed into a second position when automatic manual release is required as indicated generally by the phantom lines of FIG. 2.

Figure 2:
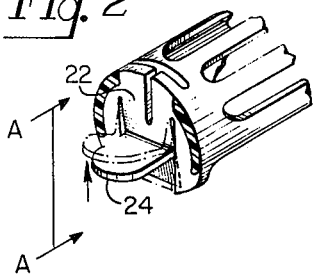
FIG. 2 is a cross-sectional view taken along line A-A showing the latching/release mechanism of the styling tool in its relaxed and deformed position, in accordance with this invention.
Figure 3:
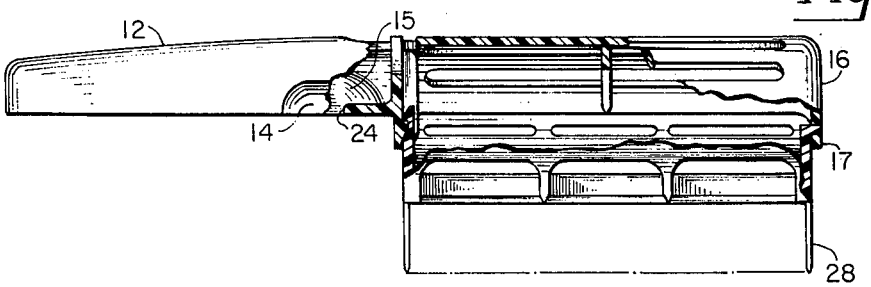
FIG. 3 is a side view, partially in cross section, of the styling tool and a styling/drying attachment in an assembled position, in accordance with this invention.
Figure 4:
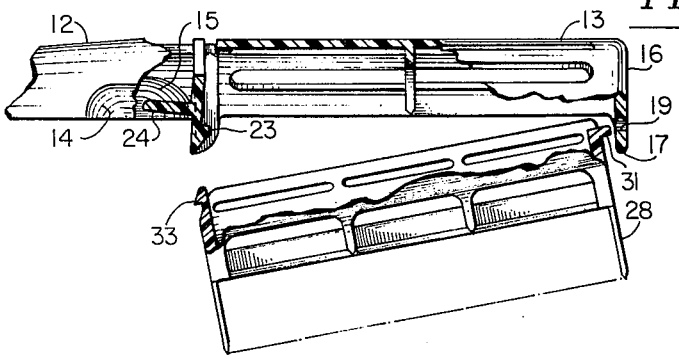
FIG. 4 is a partial side view, partially in cross section, illustrating the styling/drying attachment being assembled in the styling tool, in accordance with this invention.

Referring to FIGS. 2, 3 and 4, on the second side proximate the holding portion 11 of the latching mechanism 22 is an integrally molded release or tab member 24. The tab member 24 is disposed in the hollow of the holding portion 12 and positioned between the gripping grooves 14 and 15 to allow the thumb of the operator's hand to apply a force in the direction of the arrow in FIG. 2 to deform the latching mechanism 22 and its integrally formed detent 23. This deformation of the latching mechanism 22 allows the appropriate attachment to fall due to gravity and thereby providing automatic release with a single simple movement.

Referring now to the accessary or attachment tool generally referred to as attachment 25, an integrally molded piece of plastic is provided having a base portion 26 which generally conforms to the working portion 13 of handle 11 and may include a plurality of openings such as openings such as openings 27 to insure substantially unrestricted air flow toward its integrally related working portion 28. The working portion 18 may take the form of a comb, brush, multiple comb/-brush combination or the like and itself may be removable with respect to the base 26. At the top end 29 of the attachment 25, there is integrally molded prong or pin members 30 and 31. The pin members 30 and 31 are of sufficient length and size to align and be mated with pinholes 18 and 19 in the top end 16 of handle 11. The use of two pin members suchas 30 and 31 in substantially the same plane is a preferred embodiment in that they prevent a rocking actionassociated with prior art units. However, other configurations such as a single centrally located prong pin or with a corresponding single slot in the end member 17 and other methods of attaching are deemed to be within the scope of this invention.

The lower end 32 of attachment 25 includes a mating interlocking projection or detent 33 integrally molded to the base 26 of attachment 25. Detent 33 becomes mated with the interlocking projection 23 of handle 11 when the pin members 30 and 31 are aligned in pinholes 18 and 19 and the attachment is snapped in a manner that detent 33 slidably engages and is firmly held by detent 23.

In operation as shown in FIG. 4, the attachment 25 is positioned by the operator in a manner such that the pin members 30 and 31 are aligned to be positioned through pinholes 18 and 19. Once this is accomplished, the end 32 of the attachment 25 (or conversely the handle 13 of tool 11) is pushed with its mating member, and interlocking detents 23 and 33 respectively are slidably engaged with one another due to the spring or give associated with the integrally molded latching mechanism 23 and the specific tapered shape of the respective detents 23 and 33.

When assembled as shown in FIG. 3, the attachment 25, after being snapped in place is substantially locked therein and the skirt portion 17 of the top end 16 of the handle 11 prevents the attachment 25 from being pushed in the direction of the top end to prevent accidental disengagement.

The operator or user of the handle 11 may release his or her thumb or other finger from the holding portion 12 and with the same hand release the attachment 25 merely by applying a force in the direction indicated by the arrow of FIG. 2 to allow the interlocking projections 23 and 33 to become disengaged due to the deformation of the latching mechanism 22 in a direction from the solid to the phantom line portion of FIG. 2, i.e., clockwise deformation. Once the detent 33 becomes disengaged from detent 23, either the force of gravity, a shake of the handle 11, or the like causes pin members 30 and 31 to slide from holes 18 and 19 and resultingly, the attachment 25 is completely disengaged from the handle 11.

While an embodiment and application of this invention has been shown and described, it will be apparent to those skilled in the art that many modifications are possible without departing from the inventive concepts herein described. The invention, therefore, is not to be restricted except as necessary by the prior art and by the spirit of the apended claims.

What is deemed as new and desired to be secured by Letters Patent of the United States is :

1. Portable hair styling apparatus comprising:

a plurality of hair styling attachments, each of said attachments having a first detent member at a first end and a prong member at a second end;

an integrally molded tool having a handle portion and a working portion extending in opposite directions along an axis of said tool wherein said handle portion is generally cylindrical in shape and defines a hollow portion and further includes first and second gripping means disposed about its surface; and mating means including a latching means and a stop means integrally connected to said tool for interchangeably mounting said attachments to said tool, said latching means including a second movable detent member for mating with said first detent member of each of said attachments and further including an integrally molded tab portion positioned in said hollow portion of said handle portion proximate said first and second gripping means for moving said second detent member of said latching means in a general clockwise direction when pressed by the user of said tool and said stop means formed at an outer end of said working portion including an aperture means for receiving said prong member of each of said attachments.

2. The apparatus as in claim 1 wherein said working portion is generally cylindrical in shape and includes a plurality of generally parallel slot members for allowing air from an associated hair dryer to pass therethrough, said working portion further including a rib positioned halfway up said working portion of said tool and running transverse to said slot members.

3. The apparatus as in claim 2 wherein said prong member includes first and second pin members and said aperture means includes first and second pinholes.

4. The apparatus as in claim 3 wherein said stop means prevents each of said attachments, when mounted on said tool, from being urged off said outer end of said working portion of said tool when a force in the direction of the outer end of said working portion is applied along the axis of said tool.

* * * * *